US006065613A

United States Patent [19]

Gusdorf et al.

[11] Patent Number: 6,065,613

[45] Date of Patent: May 23, 2000

[54] SUSPENDED LOOP SUPPORTING SHOE RACK

[75] Inventors: Michael L. Gusdorf; Frederick D. Oberhaus, both of St. Louis County, Mo.

[73] Assignee: Industrial Wire Products, Inc., Sullivan, Mo.

[21] Appl. No.: 09/250,695

[22] Filed: Feb. 16, 1999

Related U.S. Application Data

[60] Provisional application No. 60/074,818, Feb. 17, 1998.

[51] Int. Cl.[7] ..... A47F 7/00

[52] U.S. Cl. ..... 211/34; 211/119; 211/181.1

[58] Field of Search ..... 211/34, 37, 119, 211/113, 117, 118, 181.1

[56] References Cited

U.S. PATENT DOCUMENTS

| | | | |
|---|---|---|---|
| 2,943,741 | 7/1960 | Atkinson | 211/37 |
| 3,198,344 | 8/1965 | Pollock . | |
| 3,913,745 | 10/1975 | Weiss . | |
| 3,918,670 | 11/1975 | Doherty . | |
| 5,076,442 | 12/1991 | Hakeem . | |
| 5,103,985 | 4/1992 | Davis | 211/34 X |
| 5,695,073 | 12/1997 | Klein et al. . | |
| 5,778,556 | 7/1998 | Ohsugi | 211/34 X |
| 5,785,185 | 7/1998 | Klebba | 211/37 |

*Primary Examiner*—Robert W. Gibson, Jr.
*Attorney, Agent, or Firm*—Paul M. Denk

[57] ABSTRACT

A suspended loop supporting shoe rack provides a series of loops, functioning as shoe supports, that extend slightly forwardly from cross rails within that span of space between a pair of side rods, into a structured shoe rack, the upper ends of the rack having a series of bends, in order to support the shoe rack from a closet rod, or related structure.

2 Claims, 1 Drawing Sheet

SUSPENDED LOOP SUPPORTING SHOE RACK

This application claims benefit to Provisional application Ser. No. 60/074,818 filed Feb. 17, 1998.

BACKGROUND OF THE INVENTION

Various types of racks for use for supporting shoes have long been available in the art. There are a wide variety of patents upon racks, for holding shoes, in various manners, but generally these types of racks are rested upon the ground, or ground supported, and are for use for holding a multitude of pairs of shoes simply laid thereon, as during their storage and non-usage. In addition, there are also suspension types of means for holding footwear, and which are generally suspended from a wall, or from a door, or perhaps even from a closet rod, but usually these type of prior art shoe holding devices include some type of a plurality of pouches, formed into a plastic or cloth holder, and into which the vamps of pairs of shoes may insert, to temporarily store the shoes, when not worn.

The current invention provides a different style of shoe rack, one which can be conveniently suspended from a closet rod, and readily displays a multitude of at least a pair of loop means, upon which the shoes may be applied, and suspended, and disposing the shoes in such manner, as to the front of the rack, so as to allow for ease of their selection, removal, or reapplication, for immediate wearing, and can be just as easily replaced, as when not in usage.

SUMMARY OF THE INVENTION

This invention contemplates the formation of a suspended shoe rack, generally of the type that incorporates a series of loop supporting members for holding shoes, and of the type that may be applied to a closet rod, or to other means of support or suspension, and allow for a plurality of pairs of shoes to be applied thereon, as during temporary storage, or in non-usage, conveniently out of place, but readily available for selection and application, when needed.

This invention includes the usage of at least a pair of suspension rods, which includes means at the upper ends for suspending the rods from a closet rod, rail, or the like, or from any other means of support. Where at least a pair of such suspension are used, a series of parallel arranged shoe supports, generally comprises of cross bracing, and which are integrally formed, and have a pair or more of loop means applied thereto, dispose the upper edge of the loop means to the front of the rack so that shoes may be applied thereto, as through the insertion of the loop means into the shoes, as during storage. When stored in this manner, the vamps of the shoes are generally available for easy viewing and inspection, and for providing visual selection, for their immediate removal and application for usage.

The essence of this invention includes the arrangement of a pair of suspension rods, that are spaced apart by means of a series of cross bracings, and which include at least a pair, or perhaps a greater number of pairs, of supporting loops that may angulate forwardly, of the rack, and readily dispose each loop for holding a shoe, into position for storage. The upper end of each suspension rod, as laterally disposed within the rack, includes a loop, so that the rack may be suspended over a closet rod, or the like, and be readily disposed for usage, within the closet, and within proximity of the remainder of the wardrobe of the user, for ready selection and application of any pair of shoes, when needed, or for their reapplication, as for storage during non-usage.

The shoe rack of this invention is designed to provide for counterbalancing, of the structure of the rack when suspended from a closet rod, and the disposition of the forwardly angulated loop means, within the structure of the rack, provides for balance, to the rack, when suspended, and loaded with a plurality of pairs of shoes, to keep the rack reasonably disposed in a vertical orientation, and to prevent its being biased rearwardly, as a result of the weight of the shoes applied thereto.

It is, therefore, a primary object of this invention to provide a suspension shoe rack, that incorporates a series of supporting loops, and which may hold a series of pairs of shoes in storage, as when not being worn.

Another object of this invention is to provide a suspension type of loop supporting shoe rack, wherein a plurality of them may be packed into an assembled configuration, nested together, so as to significantly reduce the space of their assembly, when packaged for shipment, storage, or displayed for marketing.

Another object of this invention is to provide a suspension type of looped supporting shoe rack which includes a pair of side rails, that are vertically disposed, and which include loop means at their upper ends, for immediate suspension from a closet rod, and the like.

Another object of this invention is to provide a shoe rack which can very conveniently be located within a closet, can be suspended from a closet rod, and provide a means for the temporary storage of all of the shoes of the owner, in a concentrated location.

A further object of this invention is to provide a suspension type of loop supporting shoe rack, that is properly oriented, in its structural assembly, so as to conveniently display generally the vamps of the shoes, as stored, in an upward direction, for their ready observance by the owner, to assist him/her in footwear selection for usage and application for that day.

Another object of this invention is to provide a convenient shoe rack which is streamlined in structure, conveniently utilizing various angled and arcuate elements within its structure so as to avoid the incidence of scratching or damage to the owner, or his/her wardrobe, during long term usage and application for storing of multiple pairs of shoes conveniently within a closet, or at other locations.

These and other objects may become more apparent to those skilled in the art upon reviewing the summary of the invention as provided herein, and upon undertaking a study of the description of its preferred embodiment, in view of the drawings.

DESCRIPTION OF THE PREFERRED EMBODIMENT

Figure 2:
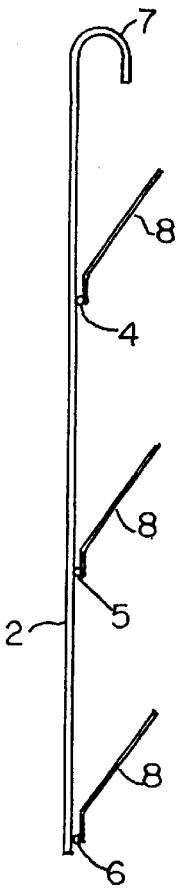
FIG. 2 is a side view thereof.
Figure 1:
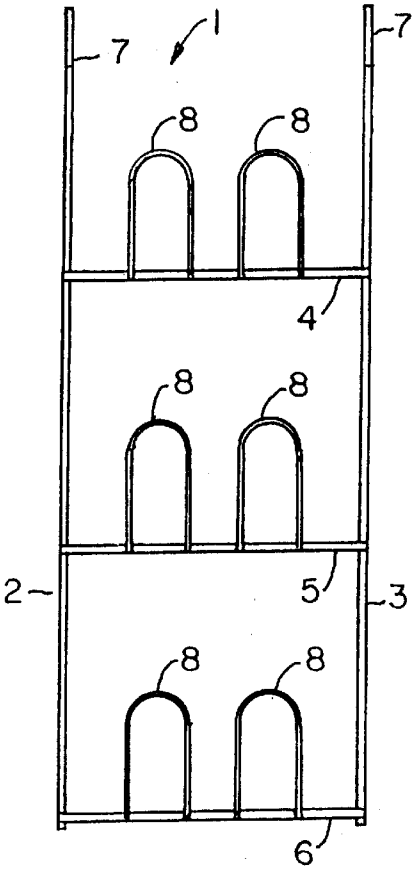
FIG. 1 is a front view of a multi-tiered suspended loop supporting shoe rack of this invention.

In referring to the drawings, and in particular FIGS. 1 and 2, the suspended loop supporting shoe rack 1 of this invention is readily disclosed. The shoe rack, as can be seen, includes a pair of side supporting rods 2 and 3, which in combination with a series of cross rails 4 through 6, provides for an erected shoe rack of the type that may be suspended from a a closet rod, or the like. The upper ends of the suspension rods 2 and 3 are turned, as at 7, and provide a means for rapidly suspending the shoe rack from a closet rod, clothesline, or other means of support, so that a plurality of shoes may be suspended upon their loop means 8, when the structure has been assembled, and readied for usage. As can be seen, the various loop means 8 are arranged upon an incline, and extend forwardly approximately 30° to 45°, as can be noted, so as to conveniently dispose their loop means for ready insertion within the shoes, as they are stored during nonusage, or to allow for their prompt sliding forwardly and upwardly, for their removal, when they are to be applied and worn.

As can be noted, the overall length of the embodiment as shown in FIGS. 1 and 2 is approximately two feet, with a spacing of approximately eight inches between the upper turned ends 7, and the location where the various loop means are affixed to their cross-bracing or rails 4 through 6, as can be seen.

As can be readily understood, a series of these suspended shoe racks may be reasonably nested together, wherein their loop means 8 will be disposed either above or below similar structure of the adjacent racks, so that a variety or plurality of them may be compactly arranged, for the convenience of their shipment, storage, or even while displayed upon the market shelf during their display for marketing. This indicates how a plurality of such shoe racks can be nested together, due to the inclined configuration and structural location of their loop means 8, as can be understood. In fact, there are approximately twelve such shoe racks nested together, into a packing assembly, when shipped for marketing, and which conveniently allows them to be either strapped together within a box, when readied for shipment, or for location within the warehouse for storage, or even when displayed in that manner, as within a retail outlet.

Figure 4:
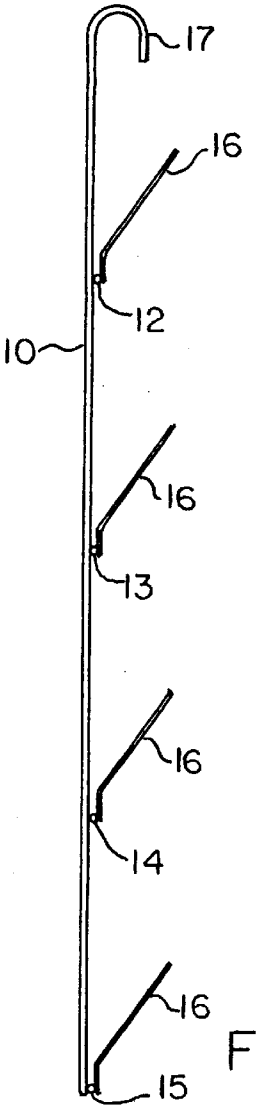
FIG. 4 is a side view thereof.
Figure 3:
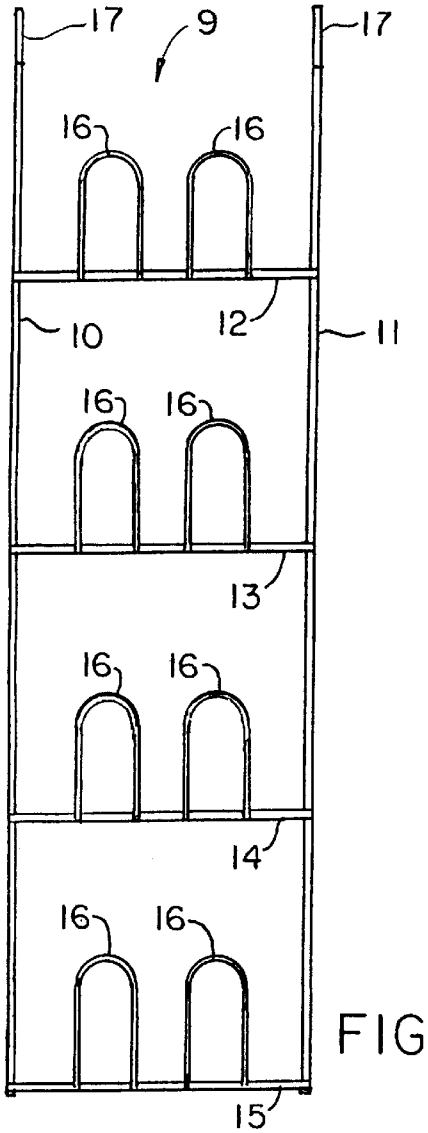
FIG. 3 is a front view of modified multi-tiered suspended loop supporting shoe rack of this invention.

As can further be noted in FIGS. 3 and 4, a more lengthened type of suspended loop supporting shoe rack of this invention is shown, as at 9. The structure of this particular rack is very similar to that as previously reviewed, it includes a pair of side rails 10 and 11, which are integrated, either by welding, or other means of fastening, with the cross-bracings 12 through 15. A series of similar type loop means 16 are welded or otherwise secured to the cross-bracings 12 through 15, as can be seen. And, these loope means are angulated forwardly, as previously described, so as to dispose their loops for ready reception of any shoes applied thereto, for storage, display, or for any other purpose. But, generally, as previously reviewed, the concept of this invention is to provide for a shoe rack that may be conveniently located within the closed, within close proximity of the entire wardrobe of the user, in order to facilitate his/her selection and usage of shoes, or their storage, as the circumstances may dictate.

Generally, the shoe rack of this invention, as described herein, will be fabricated of metal wire parts, which may be promptly assembled together, usually through welding, to furnish the type and style of racks as shown herein. In addition, while only a pair of the loop means are shown for the two embodiments of this invention as displayed in FIGS. 1 through 4, it is just as likely that the shoe rack may be widened, and correspondingly, their cross-rails 12 through 15 equally lengthened, so that more than two loop means may be provided, in the event that four, six, or other combinations of loop means may be required for the convenient storage of a plurality of shoes, of the owner, at one location. In addition, as previously explained, the bent portion 17, at the upper end of the shown rack, bends forwardly, as correspondingly does the various loop means 16, as can be noted. Hence, this has a tendency to equalize the weight of any shoes applied to the rack, to keep it generally vertically aligned, and to prevent its being biased rearwardly, towards the back wall of any closet, or the like, when it is suspended from a closet rod, and contains a plurality of shoes thereon, as during usage.

Variations or modifications to the structure and assembly of this invention may occur to those skilled in the art upon reviewing the invention as described herein. Such variations, if within the scope of this development, are intended to be encompassed within the spirit of this invention, as described herein. The description of the preferred embodiment as set forth herein, and the drawings which display that embodiment, is provided for illustrative purposes only.

What is claimed is:

1. A suspended loop shoe rack comprising:

at least two side supporting rods, said side supporting rods being in vertical orientation, and having an upper part and a lower part, said side supporting rods being parallel with respect to one another;

means provided towards the upper part of said side supporting rods for engaging a pre-existing horizontally disposed support, said means comprising a turn portion provided at the upper part of said side supporting rods, and capable of looping over a horizontally disposed support such as a closet rod;

a plurality of cross-bracing members attached to said side supporting rods such that said cross-bracing members are disposed perpendicular to said side supporting rods;

a plurality of loop means, each of said loop means attached at one end to corresponding cross-bracing members such that the loop portions project upwardly from the cross-bracing members and forward at an angle to the vertical; and wherein said plurality of loop means project forwardly at an angle of between about 30° and 45° degrees from the vertical.

2. The suspended loop shoe rack of claim 1 and wherein a plurality of such suspended loop shoe racks may be nested together during shipment and storage.

* * * * *